US005276945A

United States Patent [19]

Matsumura

[11] Patent Number: 5,276,945

[45] Date of Patent: Jan. 11, 1994

[54] HINGE DEVICE HAVING DIRECTIONAL DAMPING

[76] Inventor: Shuji Matsumura, 1-17-14, Aoyama, Shijimi-cho, Miki-shi, Hyogo-ken, Japan

[21] Appl. No.: 971,571

[22] Filed: Nov. 5, 1992

[30] Foreign Application Priority Data

Nov. 5, 1991 [JP] Japan ..... 3-099387[U]

[51] Int. Cl.[5] ..... E05D 11/08

[52] U.S. Cl. ..... 16/337; 188/82.84; 16/86 R; 4/240; 4/246.1

[58] Field of Search ..... 188/82.84, 82.9; 192/44, 45, 38; 4/236, 240, 246.1; 16/337, 241, 242, 86 R

[56] References Cited

U.S. PATENT DOCUMENTS

| | | | |
|---|---|---|---|
| 2,073,726 | 3/1937 | Bates | 188/82.84 X |
| 4,734,955 | 4/1988 | Connor | 16/342 X |
| 4,794,669 | 1/1989 | Sanders | 16/341 |

FOREIGN PATENT DOCUMENTS

| | | | |
|---|---|---|---|
| 78016 | 8/1954 | Denmark | 16/342 |
| 2215247 | 11/1973 | Fed. Rep. of Germany | 4/236 |
| 13781 | 4/1911 | France | 192/45 |
| 583357 | 1/1925 | France | 188/82.84 |
| 1037925 | 9/1953 | France | 192/45 |
| 26594 | 1/1990 | Japan . | |

*Primary Examiner*—Robert J. Oberleitner
*Assistant Examiner*—Kevin D. Rutherford
*Attorney, Agent, or Firm*—Wegner, Cantor, Mueller & Player

[57] ABSTRACT

A buffering device used in a hinge structure of a lid or cover, such as stool lid of a toilet stool of Western style, which is pivoted on a horizontal axis and generally opened upwards by hand and closed downwards by gravity, comprising two members such as of coaxial cylinder type having mutually facing surfaces, respectively, and being combined coaxially to enable relative rotation, and at least one idle member disposed within a gap between the facing surfaces to roll with the relative rotation, and including no buffering fluid, in which the torque for closure is made large as compared with the torque for opening, so that the lid can be opened lightly when it is opened by hand, while it is automatically braked for preventing it from colliding against the stool body to produce an undesirable strike sound when it is naturally closed by gravity.

19 Claims, 4 Drawing Sheets

HINGE DEVICE HAVING DIRECTIONAL DAMPING

BACKGROUND OF THE INVENTION

This invention relates to a damper device and, especially to a buffering assembly used in a hinge structure of a lid or cover, such as a stool lid of a toilet stool of Western style or a cover of a personal computer of wrap-top type which is opened upwards and closed downwards.

Such manually operated lid or cover which is hinged about a horizontal axis can be opened lightly if the frictional resistance between an axle and a bearing of the hinge structure is small. However, if it is released from a hand when it is closed, it freely runs down against a body to cause not only an unpleasant strike sound but also a possible damage of the device due to shock. However, if the frictional resistance is increased for preventing these problems, unnecessary resistance acts at the time of opening and the hand must be used to the last at the time of closing. In order to avoid such troubles, it has been proposed, as described, for example, in the Japanese utility model opening gazette No. H2-6594, to use a buffering fluid such as grease for braking the lid therewith when it is closed. However, such a device as using a fluid is complicated in structure and, moreover, it conceives such problems in that it is troublesome to handle the fluid in the manufacturing process and it may leak out in the future. With this structure, moreover, a long time is needed for closure when only the gravity regards, since a uniform braking torque acts throughout the closing operation.

Accordingly, an object of this invention is to provide a novel and improved damper device using no buffering fluid, in which the braking effect does not appear at the time of opening but appears only at the time of closing.

Another object of this invention is to provide an improved damper device for a hinge structure in which the braking effect at the time of closing is raised especially at the last step to prevent collision of the lid.

A further object of this invention is to provide an improved damper device in which the braking effect is raised especially within a specific range in the way of closing, so that the lid can be stood still at any position within the range.

SUMMARY OF THE INVENTION

According to a feature of this invention, the damper device, which is generally used in a hinge structure including two hinge members pivoted about an axis, comprises two principal members to be fixed to the hinge members, respectively which have mutually facing surfaces, respectively, and are coaxially combined with each other to enable relative rotation, and at least one idle member disposed between the facing surfaces, and at least one of the principal members and idle member includes an elastic material. At least a portion of one of the facing surfaces has a first depression and a second depression shallower than the first depression, which are formed therein in circumferentially adjoining and partly overlapping relation and the idle member lies in one of these depressions. The idle member moves from the first depression to the second depression with friction when one of the principal members is rotated forward with respect to the other, while it moves from the second depression to the first depression when it is rotated backward. Accordingly, the forward rotation is effected lightly and easily due to reduced friction or resistance, while the backward rotation tends to be braked due to raised friction or resistance.

According to another feature of this invention, the other facing surface having no depression is raised at a portion thereof which the idle member passes in the abovementioned backward rotation thereby increasing the braking effect within that portion.

These and other features and operation of this invention will be described in more detail below in connection with some preferred embodiments thereof with reference to the accompanying drawings.

BRIEF DESCRIPTION OF THE DRAWINGS

In the drawings.

Throughout the drawings, same reference numerals are given to structural components which correspond in function.

DESCRIPTION OF THE PREFERRED EMBODIMENTS

Figure 1:
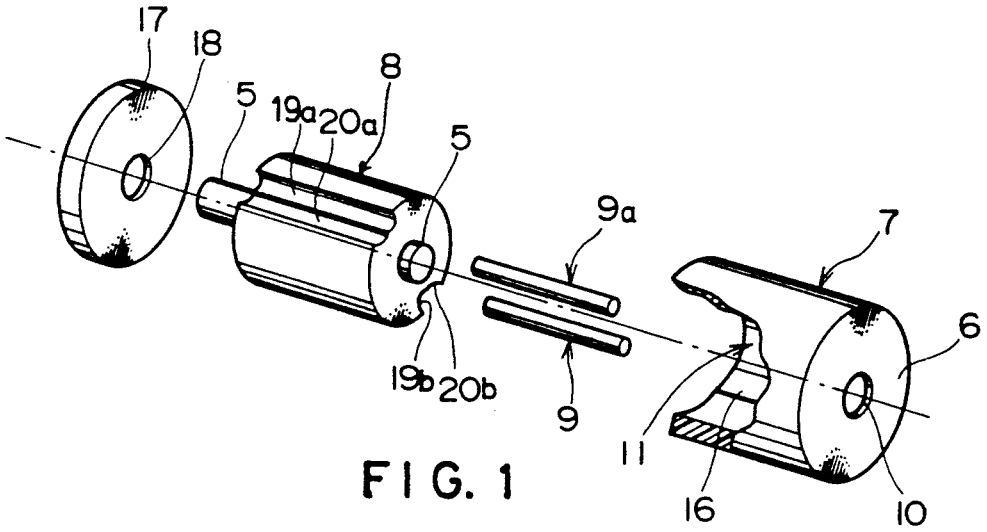
FIG. 1 is an exploded perspective view of an embodiment of the damper device according to this invention.

Referring to FIG. 1 the damper device of this invention comprises a cylindrical inner body 8 having an axle 5 which is integrated therewith to be fixed to a lid of a toilet stool (not shown), for example, and a cylindrical cup-like outer body 7 having an end wall 6 to be fixed to a body (not shown) of the toilet stool, for example, and a pair of round rod-like idle members 9*a* and 9*b* disposed between both bodies 7 and 8. The inner body 8 is loosely inserted in the outer body 7 and one end of its axle 5 is rotatably supported in a central hole 10 of the outer body 7. The outer body 7 has another end wall 17 having a central hole 18 and the end wall 17 is fit in and fixed to the opening of the outer body 7 after the inner body 8 is inserted in the cup member 7. Then, the other end of the axle 5 of the inner body 8 is inserted and rotatably supported in the central hole 18 of the end wall 17. Accordingly, the inner body 8 is freely rotatable within the outer body 7 and a gap which is less than the diameter of the idle members 9*a* and 9*b* is kept therebetween. In the outer wall of the inner body 8, two pairs of longitudinal grooves 19*a*, 19*b* and 20*a*, 20*b* are formed adjoiningly at axially symmetric positions. The first grooves 19*a* and 19*b* are a little deeper than the second grooves 20*a* and 20*b* and both grooves are partly connected as shown to form a low barrier therebetween. In this embodiment, both bodies 7 and 8 are formed of hard plastic and the idle members 9*a* and 9*b* formed of elastic rubber. The idle members 9*a* and 9*b* lie always in one of the first and second grooves and can roll and elastically get over the barrier between the first and second grooves to move from one to the other since they are in contact with both members 7 and 8.

Figure 2:
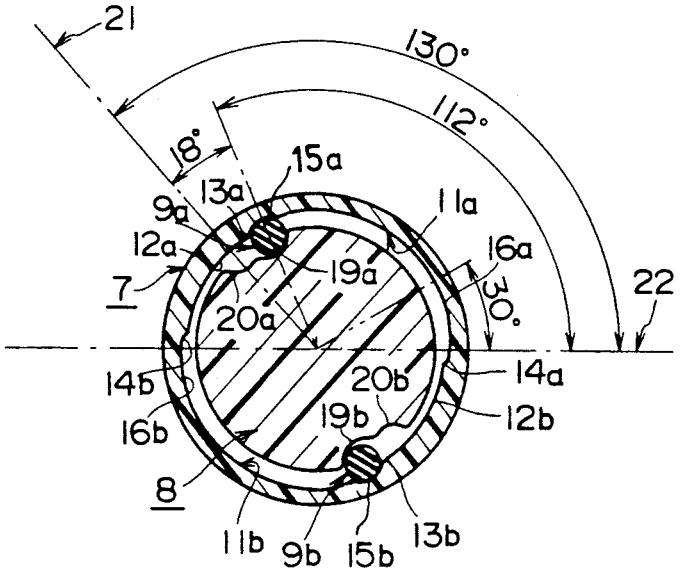
FIGS. 2 to 7 are cross-sectional views of the embodiment of FIG. 1 illustrative of the operation thereof.

As is shown more clearly in FIG. 2, the inner wall of the outer body 7 is depressed symmetrically across central angles of about 112 degrees each to form rolling surfaces 11*a* and 11*b* having first steps 13*a* and 13*b* and second steps 14*a* and 14*b*, respectively, at both ends thereof. Thus, a pair of mesas 12*a* and 12*b* are formed between the rolling surfaces 11*a* and 11*b*. A pair of shallow detent grooves 15*a* and 15*b* are formed adjacent to the first steps 13*a* and 13*b* at one each of the rolling surfaces 11*a* and 11*b* and a pair of portions 16*a* and 16*b* adjoining the other ends thereof and corresponding to central angles of about 30 degrees each are a little raised from the remainder of the rolling surfaces or ascended toward the mesas.

In the drawing, when the inner body 8 is rotated counterclockwise with respect to the outer body 7, the idle members 9*a* and 9*b* roll or slip on the rolling surfaces 11*a* and 11*b* while being held in the first grooves 19*a* and 19*b*, respectively. Thereafter, they collide against the first steps 13*a* and 13*b* and enter the detent grooves 15*a* and 15*b* to come to a stop. There are a pair of central angles of about 18 degrees each between the first and second grooves 19*a*, 19*b* and 20*a*, 20*b* formed in the inner body 8; and the stool lid (not shown) is fixed to the inner body 8 along a radius 21 thereof corresponding to the second groove 20*a*. On the other hand, the outer body 7 is fixed to the toilet stool body (not shown) so that its diameter 22 nearly corresponding to the second steps 14*a* and 14*b* lies in a horizontal plane. Accordingly, the stool lid forms an angle of about 130 degrees with respect to the horizontal plane 22 when it is fully opened.

Figure 3:
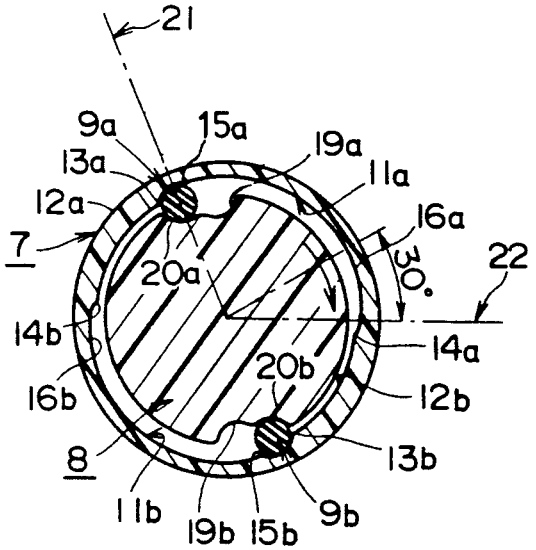
Figure 4:
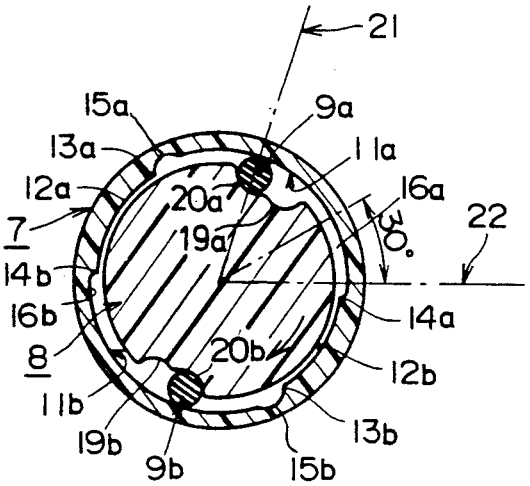
Figure 5:
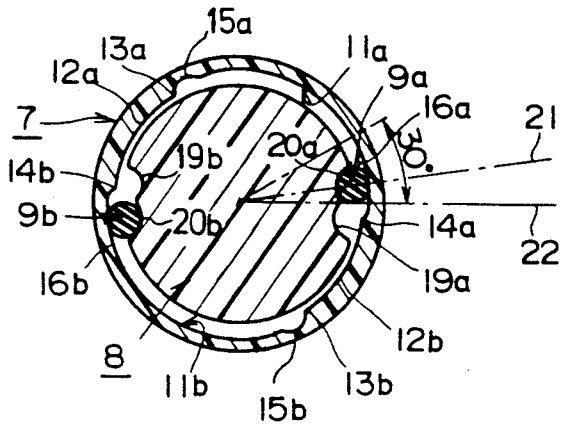
Figure 6:
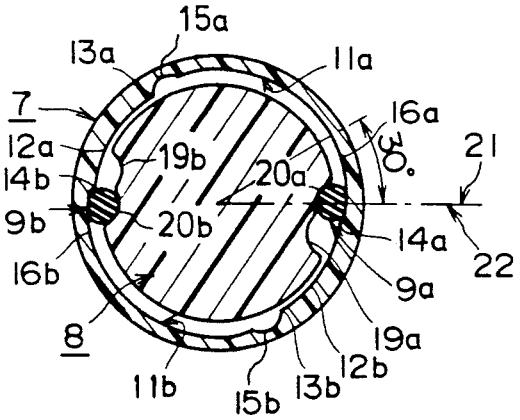

Next, when the inner body 8 is rotated clockwise from the state of FIG. 2 to close the stool lid (not shown), the idle members 9*a* and 9*b* roll within the detent grooves 15*a* and 15*b* and move from the first grooves 19*a* and 19*b* to the second grooves 20*a* and 20*b* while being elastically compressed, as shown in FIG. 3. If the inner body 8 is further rotated the idle members 9*a* and 9*b* leave the detent grooves 15*a* and 15*b* as shown in FIG. 4 and roll or slip on the rolling surfaces 11*a* and 11*b* in some compressed state. At last the idle members 9*a* and 9*b* pass the raised or ascended portions 16*a* and 16*b* while being slightly compressed as shown in FIG. 5 and then collide against the second steps 14*a* and 14*b* to come to a stop as shown in FIG. 6. When the stool lid (as shown schematically with a phantom line 21) is closed therefore, it is subjected to some braking torque which increases at the last step. Accordingly, the stool lid should not collide against the stool body if it is released from a hand.

Figure 7:
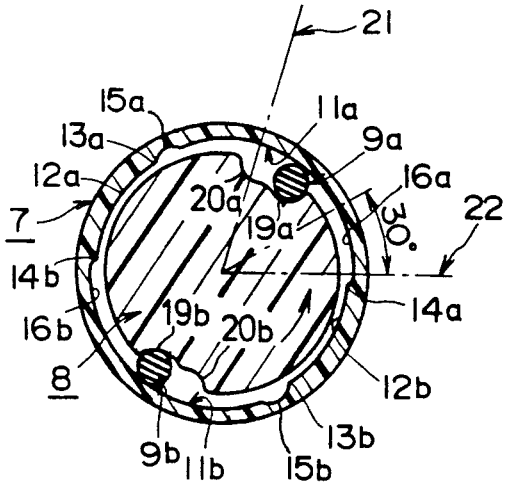

Then, if the inner body 8 is rotated counterclockwise when the stool lid is opened, the idle members 9*a* and 9*b* roll between both bodies 7 and 8 and move from the second grooves 20*a* and 20*b* to the deeper first grooves 19*a* and 19*b* to expand elastically. If the rotation is continued, the idle members 9*a* and 9*b* pass the raised or ascended portions 16*a* and 16*b* as being released from compression as shown in FIG. 7 and go through the rolling surfaces 11*a* and 11*b* to return to the full open state of FIG. 2. Accordingly, the stool lid con be lightly opened since the frictional resistance disappears almost.

Figure 8:
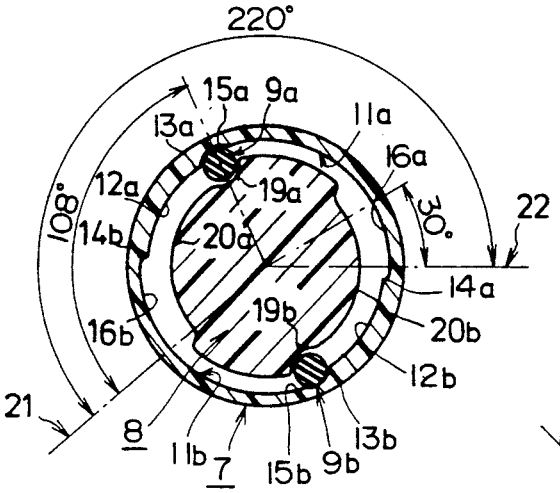
FIGS. 8 and 9 are cross-sectional views showing variations of the embodiment of FIG. 1.

While the open lid angle (130 degrees in the drawing) cannot exceed 180 degrees in the design of the above embodiment, FIG. 8 shows a design variation which enables it. In this variation, the width of the second grooves 20*a* and 20*b* of the inner body 8 is much greater than the width of the first grooves 19*a* and 19*b* and the idle members 9*a* and 9*b* can move on the surface of the inner body 8 across a central angle of about 108 degrees instead of 18 degrees in FIG. 2. Accordingly, the angle of rotation of the inner body 8 is increased by the difference therebetween and the open lid angle becomes 220 degrees. This variation is advantageous for use in lid and door, such as those used in office automation equipments, which need a large open angle.

When the lid or door (schematically shown with a phantom line 21) is closed from its full open state of FIG. 8 in which the idle members 9*a* and 9*b* lie in the detent grooves 15*a* and 15*b* of the outer body 7 and the first grooves 19*a* and 19*b* of the inner body 8, if the inner body 8 is rotated clockwise, the idle members 9*a* and 9*b* first get over the second grooves 20*a* and 20*b* and compressed, and then roll or slip to the other ends thereof (position of the phantom line 21) with rotation of the inner body 8. Thereafter, they roll or slip on the rolling surfaces 11*a* and 11*b* and pass the raised or ascended portions 16*a* and 16*b* to reach the closed position (of the phantom line 22) as same as in the embodiment of FIG. 1. Therefore, the rotation is braked similarly at the time of closing. Next, when the lid is opened the idle members 9*a* and 9*b* roll as being compressed between the rolling surfaces 11*a* and 11*b* and the wide second groove 20*a* and 20*b* brake the rotation at first, while they are released from compression to provide easy light rotation as above-mentioned to the last after they enter the first grooves 19*a* and 19*b*.

Although the width of the second grooves 20*a* and 20*b* is increased in the variation of FIG. 8, it is understood that a similar effect is obtainable by widening the first grooves 19*a* and 19*b* or both grooves. Such selection may be made in accordance with use of the device.

Figure 9:
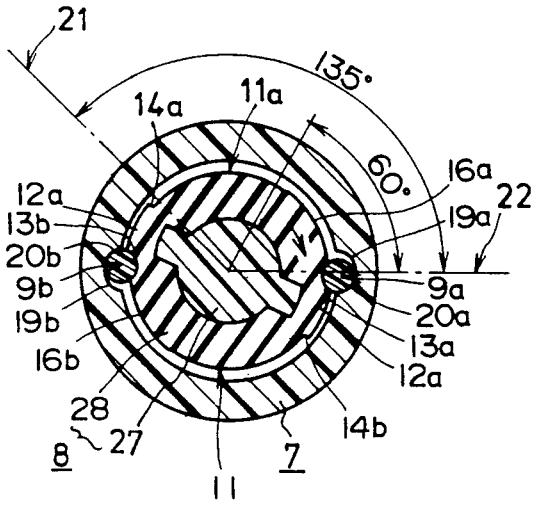

While, in the above embodiment, the first and second grooves 19*a*, 19*b* and 20*a*, 20*b* are formed in the inner body 8 and the raised or ascended portions 16*a* and 16*b* are formed on the outer body 7, the same effect is obtainable even if the grooves are formed in the outer body and the raised or ascended portions are formed on the inner body. Moreover, while the idle members 9*a* and 9*b* are formed of rubber in the above embodiment, a similar effect is expectable even if the inner or outer body is made of rubber. FIG. 9 shows another variation in which the grooves are formed in the outer body and part of the inner body is made of rubber.

In the drawing, the inner body 8 is composed of a core portion 27 and a shell portion 28 and the core and shell portions 27 and 28 are made of hard plastic and elastic rubber, respectively. Part of the cylindrical surface of the shell portion 28 is depressed symmetrically to form a pair of rolling surfaces 11*a* and 11*b* corresponding to central angles of about 135 degrees each. A pair of first steps 13*a* and 13*b* are formed at one each of the rolling surfaces 11*a* and 11*b* and second steps 14*a* and 14*b* are formed at the other end. A device lid is fixed to the core portion 27 of the inner body 8 along a radius 21 corresponding to the second step 14*a*. A pair of raised or ascended portions 16*a* and 16*b* are formed on the rolling surfaces 11*a* and 11*b* in correspondence to central angles of about 60 degrees each from the first steps 13*a* and 13*b*. The idle members 9*a* and 9*b* are made of hard plastic and lie in two pairs of grooves 19*a*, 19*b* and 20*a*, 20*b* formed symmetrically in the inner wall of the outer body 7. The outer body 7 is fixed to the device body so that its diameter 22 passing the first grooves 19*a* and 19*b* lies horizontally.

When the inner body 8 is rotated in clockwise direction as arrowed for closing the device lid 21, the hard idle members 9*a* and 9*b* move first to the shallower second grooves 20*a* and 20*b* as shown and partially sink in the relatively soft shell portion 28 of the inner body 8. With rotation of the inner body 8, the idle members 9*a* and 9*b* roll, as they are, over the raised portions 16*a* and 16*b* of the shell portion 28 across a central angle of about 60 degrees. Accordingly, there is a large resistance for this time and the lid 21 can hold still, without external assistance, at any position. After the idle members 9*a* and 9*b* pass the raised portions 16*a* and 16*b*, their sinking in the shell portion 28 is reduced and the frictional resistance is also reduced to enable smooth closing of the lid 21. When the lid is opened, the idle members 9*a* and 9*b* move to the deeper first grooves 19*a* and 19*b* as aforementioned. Therefore, the frictional resistance is further reduced and it becomes much easier and lighter to open the lid. This variation may be utilized effectively, for example, in a wrap-top type personal computer having a liquid crystal display board attached to its lid. In this case, the lid may be rotated in closing direction by a suitable angle and stood still at a position where the display on the board can be observed most clearly, after it is once fully opened. In this case, moreover, if it is arranged that the second steps 14*a* and 14*b* of the inner body 8 are slightly deformed elastically by the idle members 9*a* and 9*b* and the lid is latched when the lid is fully closed, the lid is elastically opened a little when the latch is released, and it becomes easy to catch it with fingers.

Figure 10:
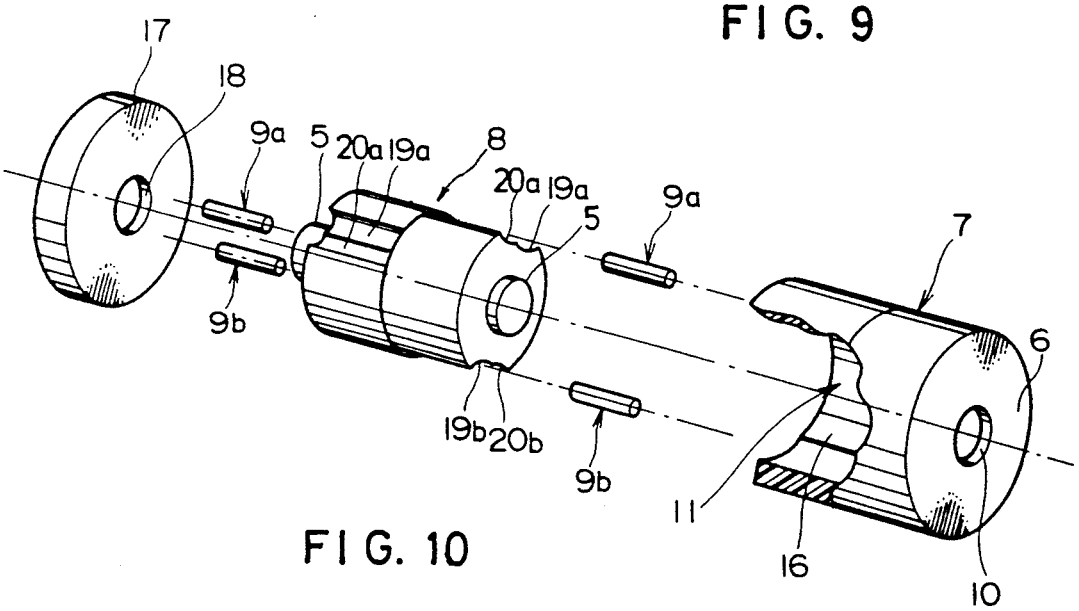
FIGS. 10 to 12 are exploded perspective views showing other variations of the embodiment of FIG. 1.

While, in the above embodiment, a pair of idle members 9*a* and 9*b* are disposed at both ends of a diameter, a single idle member may be used. However, it is recommendable to use two or more idle members circumferentially at equal intervals in order to avoid eccentric load and assure smooth rotation. FIG. 10 shows an example in which four idle members are disposed at intervals of 90 degrees. In this example, outer and inner bodies 7 and 8 are halved normally to their axes, both halves are joined together with 90 degree rotation and a pair of idle members 9*a* and 9*b* are disposed in each half.

Figure 11:
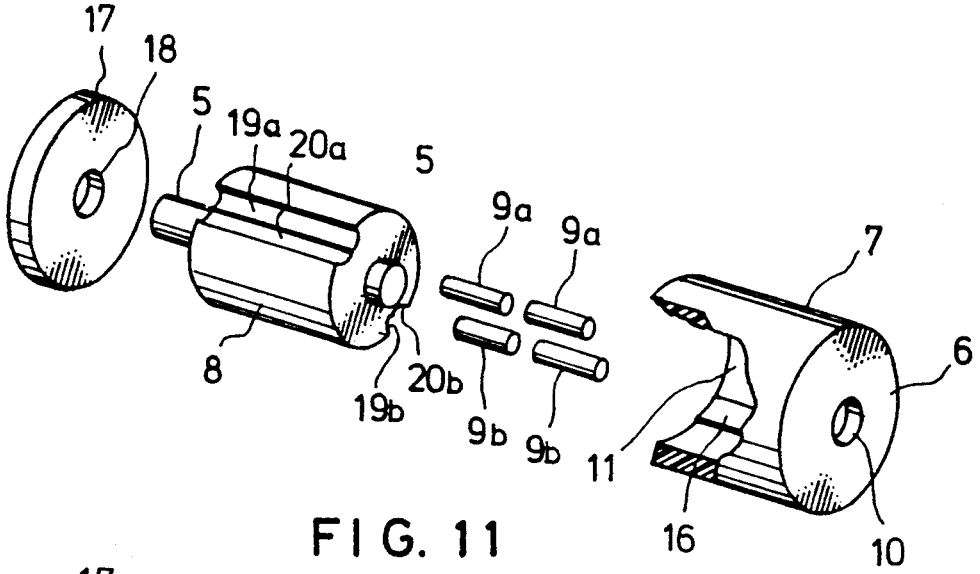

FIG. 11 shows a variation of FIG. 1 in which the idle members 9*a* and 9*b* are divided into plural pieces (two pieces in the drawing) each. The idle members 9*a* and 9*b* may be subjected to undesirable distortion when they are made or rubber and considerably long. This variation is effective to avoid such trouble. Moreover, this variation can delicately modify a braking mode by giving mutually different diameters to the respective idle members.

Figure 12:
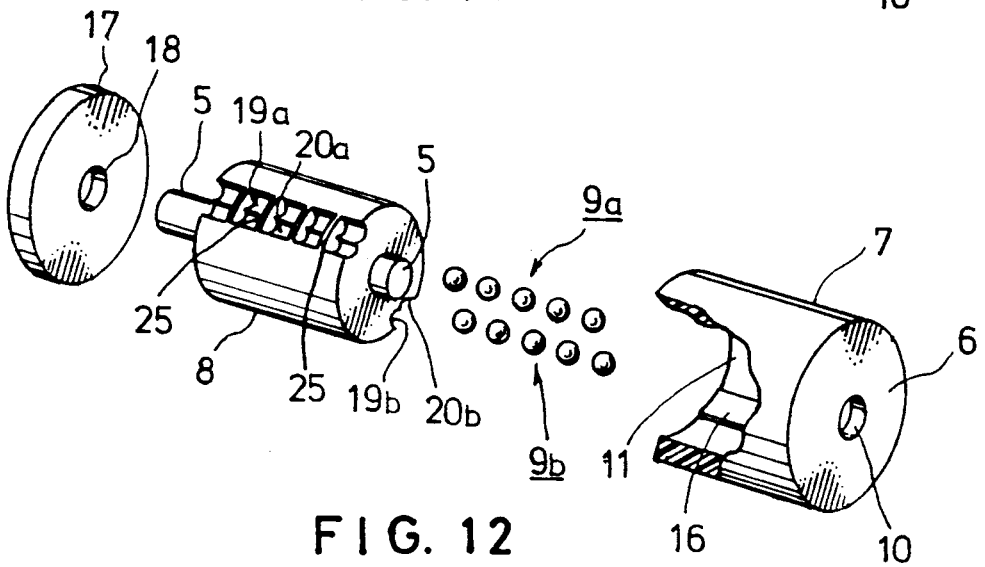

FIG. 12 shows a further variation of the variation of FIG. 11, in which the divided idle members 9*a* and 9*b* are substituted with a series of balls. In this example, the grooves are provided with partitions 25 in order to prevent irregular longitudinal distribution of the balls. The balls may be substituted with other kind of bodies of revolution such as ellipsoids of revolution.

Figure 13:
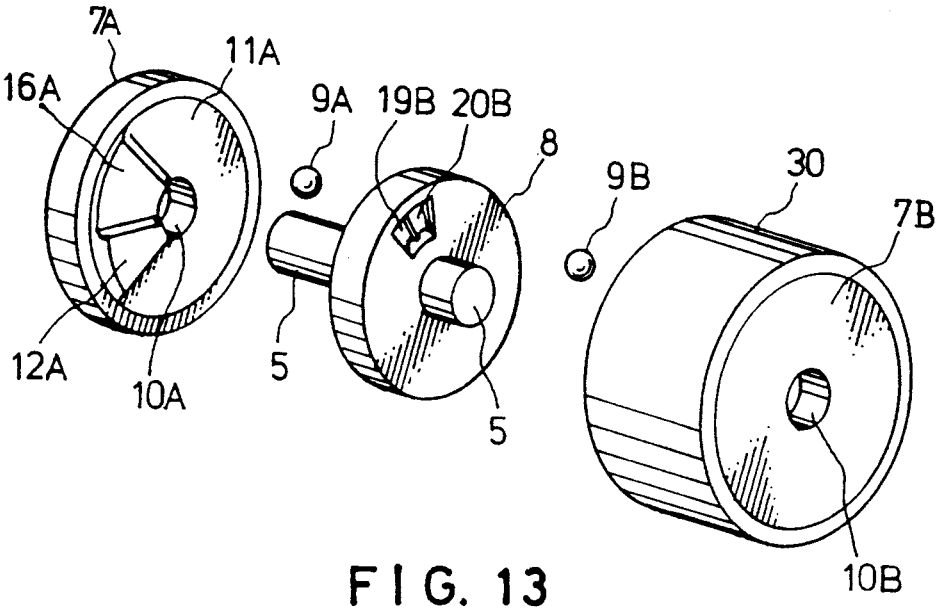
FIG. 13 is an exploded perspective view of another embodiment of the damper device of this invention.

While, in the above-mentioned embodiment, the facing surfaces of the outer and inner bodies 7 and 8 are cylindrical, it is obvious that a similar effect is obtainable even if they are conical. While the facing surfaces will be two planes normal to the axis if the vertical angle of the conical surface is 180 degrees, such structure is also within the technical range of this invention. An embodiment thereof is shown in FIG. 13.

In the drawing, the damper device includes two outer discs 7A and 7B corresponding to the outer body 7 of the embodiment of FIG. 1 and an inner disc 8 corresponding to the inner body 8 thereof. These members are assembled by passing a rotational shaft 5 fixed to the inner disc 8 through central holes 10A and 10B of the outer discs 7A and 7B and fitting a cylindrical shell 30 on the outer discs 7A and 7B and, in this state, the inner disc 8 is rotatable with respect to the outer discs 7A and 7B. As shown, a mesa 12A, a raised portion 16A and a rolling surface 11A respectively corresponding to the mesas 12*a* and 12*b*, raised portions 16*a* and 16*b* and rolling surfaces 11*a* and 11*b* of FIG. 2 are formed on the inner surface of one outer disc 7A and, though not shown in the drawing, similar mesa 12B, raised portion 16B and rolling surface 11B are formed on the inner surface of the other outer disc 7B. A pair of depressions 19B and 20B corresponding to the grooves 19*a*, 20*a* and 19*b*, 20*b* of the embodiment of FIG. 1 are formed in one surface of the inner disc 8 and, though not shown in the drawing, similar depressions 19A and 20A are formed in the other surface of the inner disc 8. At the time of assembling, balls 9A and 9B corresponding to the idle members 9*a* and 9*b* of the embodiment of FIG. 1 are put in these depressions. While any one of the inner and outer discs and idle members is made of an elastic material also in this case, its selection depends upon use and usage of the device. The operation of this embodiment will not be described further since it will be obvious from the operation of the embodiment of FIG. 1. However, it is understood that an angle of rotation almost close to 360 degrees is obtained in this embodiment by reducing the width of the mesa 12A.

The above embodiments are provided for illustrative purpose only and do not mean any limitation of the invention. It should be obvious to those skilled in the art that various modifications and changes can be made on these embodiments without leaving the spirit and scope of the invention as defined in the appended claims.

For example, the sizes and angles used in the above description can be selected arbitrarily in accordance with the use of the device. Although a ridge which separates the first and second grooves is shown therebetween in the drawings, the less the interval of the grooves, the lower the ridge and, at last, the two grooves may become a single groove having a simple slanting bottom. In other words, it should be noted that presence of the ridge is not included in the limiting conditions of the invention. Although the first and second grooves are shown as parallel to the axis of the device, they need not be parallel but may be slanting with respect to a generator of the cylinder as a tooth of a helical gear. If so, such an effect as similar to the helical gear, that is, smoother rotation will be obtained. The idle member need not always contact with the facing rolling surface. A necessary condition of this invention is that the idle member is urged against the facing surface to move from the first groove to the second groove or vice versa in a part of the relative rotation (e.g., at the beginning or end thereof), and it may not contact with the facing surface in the other part, especially, in the process of opening the lid. The hard plastic material may be substituted with any other hard material such as metal and the elastic rubber may be substituted also with any other elastic material such as synthetic resin having elasticity.

Although, in the above description, the outer body 7 is fixed to a main body of the device for use and the inner body 8 is fixed to its lid, its converse is also possible. A plurality of such damper devices may be connected in series for use. For example, when a plurality of hinge structures are disposed on a single axis as in the case of stool lid and stool seat of a toilet stool, the damper may be provided with a single outer body fixed to the stool body and two inner bodies respectively fixed to the lid and seat and having their own idle members. Moreover, the inventive damper device may be used not only in a hinge structure having a horizontal axis as above-mentioned, but also in those having vertical and slanting axes. In other words, it may be used in a hinge structure for an entrance door.

I claim:

1. A hinge device comprising:

at least two principal members having mutually facing surfaces and coaxially combined to be capable of relative rotation, at least one idle member disposed between said facing surfaces to roll with said relative rotation, at least one selected from said principal members and said idle member including an elastically deformable material, means for damping said hinge during said relative rotation in a first direction more than damping said hinge during relative rotation in a second direction which is opposite to said first direction;

at least one of said facing surfaces having at least one pair of depressions formed therein for containing each said idle member corresponding thereto, each said pair of depressions consisting of a first depression and a second depression which is shallower than said first depression and adjoining thereto in a direction of rotation and partially overlapping therewith, and said facing surfaces having a spacing therebetween such that each said idle member is held within said depressions corresponding thereto and put in contact with another of said facing surfaces to enable movement of said idle member from said first depression to said second depression and thus effect said damping during at least a part of said relative rotation of said principal members in said first direction and from said second depression to said first depression in at least a part of said relative rotation in said second direction opposite to said first direction.

2. A device as set forth in claim 1, wherein the other of said facing surfaces has at least one raised portion for reducing said spacing between said facing surfaces in order to brake movement of said idle member therealong and thus increase said damping of said hinge in said first direction of relative rotation.

3. A hinge device comprising:

an outer body having an inner cavity with a cylindrical inner wall, an inner body having a cylindrical outer wall and being disposed in said inner cavity of said outer body to be capable of coaxial relative rotation therewith, at least one idle member disposed between said outer and inner bodies;

at least one selected from said outer and inner bodies and said idle member including an elastically deformable material, means for damping said hinge during said relative rotation in a first direction more than damping said hinge during relative rotation in a second direction which is opposite to said first direction;

one of said inner wall of the outer body and said outer wall of the inner body having at least a pair of depressions formed therein for containing each said idle member corresponding thereto, each said pair of depressions consisting of a first depression and a second depression which is shallower than said first depression and circumferentially adjoining thereto and partially overlapping therewith, and said inner wall of the outer body and said outer wall of the inner body having a spacing therebetween such that said idle member is held within said pair of depressions corresponding thereto and put in contact with a facing other wall, of said inner wall of said outer body and said outer wall of said inner body, to enable moving of said idler member from said first depression to said second depression and thus effect said damping during at least a part of said relative rotation said first direction and from said second depression to said first depression in at least a part of said relative rotation in said second direction opposite to said first direction.

4. A device as set forth in claim 3, wherein the other of said inner wall of the outer body and said outer wall of the inner body has at least one raised portion for reducing said spacing between said inner and outer walls in order to brake movement of said idle member therealong and thus increase said damping of said hinge in said first direction of relative rotation.

5. A device as set forth in claim 3, wherein the other of said inner wall of the outer body and said outer wall of the inner body has at least one projection for butting against said idle member to stop said relative rotation.

6. A device as set forth in claim 3, wherein said first and second depressions are two parallel grooves, and said idle member is a round rod in shape.

7. A device as set forth in claim 3, wherein said idle member is a spherical ball in shape.

8. A hinge device comprising:

an outer body having an inner cavity with a cylindrical inner wall, an inner body including an elastically deformable material, having a cylindrical outer wall and being disposed in said inner cavity of said outer body to be capable of coaxial relative rotation therewith, at least one idle member disposed between said outer and inner bodies;

means for damping said hinge during said relative rotation in a first direction more than damping said hinge during relative rotation in a second direction which is opposite to said first direction;

said inner wall of the outer body having at least a pair of depressions formed therein or containing each said idle member corresponding thereto, each said pair of depressions consisting of a first depression and a second depression which is shallower than said first depression and circumferentially adjoining thereto and partially overlapping therewith, said inner wall of the outer body and said outer wall of the inner body having a spacing therebetween such that said idle member is held within said pair of depressions corresponding thereto and put in contact with a facing other wall, of said inner wall of said outer body and said outer wall of said inner body, to enable moving of said idler member from said first depression to said second depression and thus effect said damping during at least a part of said relative rotation in said first direction and from said second depression to said first depression in at least a part of said relative rotation in said second direction opposite to said first direction, and said outer wall of the inner body having at least one raised portion for reducing said spacing between said inner and outer walls in order to brake movement of said idle member therealong and thus increase said damping of said hinge in said first direction of relative rotation.

9. A device as set forth in claim 8, wherein said raised portion of the outer wall of said inner body is located adjacent to a start point of the movement of said idle member in said first direction across a predetermined angle.

10. A device as set forth in claim 8, wherein said outer wall of the inner body has at least one projection for butting against said idle member to stop said relative rotation.

11. A device as set forth in claim 8, wherein said first and second depressions are two parallel grooves, and said idle member is a round rod in shape.

12. A hinge device comprising:

two principal members having mutually facing principals surfaces and being capable of relative rotation about a common central axis normal to said principal surfaces, at least one idle member disposed between said facing principal surfaces, at least one selected from said principal members and said idle member including an elastically deformable material, means for damping said hinge during said relative rotation in a first direction more than damping said hinge during relative rotation in a second direction which is opposite to said first direction;

one of said facing principal surfaces having at least one pair of depressions formed therein for containing each said idle member corresponding thereto, each said pair of depressions consisting of a first depression and a second depression which is shallower than said first depression and circumferentially adjoining thereto and partially overlapping therewith, and said facing surfaces having a spacing therebetween such that each of said idle member is held within said depressions corresponding thereto and put in contact with another of said facing surfaces to enable movement of said idle member from said first depression to said second depression and thus effect said damping during at least a part of said relative rotation of said first direction and from said second depression to said first depression in at least a part of said relative rotation in said second direction opposite to said first direction.

13. A device as set forth in claim 12, wherein the other of said facing principal surfaces has at least one raised portion for reducing said spacing between said principal surface in order to brake movement of said idle member therealong and thus increase said damping of said hinge in said first direction of relative rotation.

14. A device as set forth in claim 12, wherein the other of said facing principal surfaces has at least one projection for butting against said idle member to stop said relative rotation.

15. A device as set forth in claim 12, wherein said idle member is a spherical ball in shape.

16. A hinge device comprising:

an outer body having an inner cavity with a cylindrical inner wall, an inner body having a cylindrical outer wall and being disposed in said inner cavity of said outer body to be capable of coaxial relative rotation therewith, at least one idle member disposed including an elastically deformable material and being disposed between said outer and inner bodies, said outer wall of the inner body having at least a pair of depressions formed therein for containing said idle member, each pair of said depressions consisting of a first depression and a second depression which is shallower than said first depression and circumferentially adjoining thereto and partially overlapping therewith, the space between said inner wall of the outer body and said outer wall of the inner body being selected so that said idle member is held within said depressions and put in contact with the facing wall to be capable of moving from said first depression to said second depression in at least a part of said relative rotation in a first direction and then moving continuously along said facing wall, and from said second depression to said first depression in at least a part of said relative rotation in a second direction opposite to said first direction and then moving continuously along said facing wall, whereby said relative rotating in said first direction is braked due to increase in the degree of compression of said idle member more than said relative rotation in said second direction, and said inner wall of the outer body having at least one raised portion for reducing the space between said inner and outer walls to additionally brake said relative rotation.

17. A device as set forth in claim 16, wherein said raised portion of the inner wall of said outer body is located adjacent to an end point of the movement of said idle member in said first direction across a predetermined angle.

18. A device as set forth in claim 16, wherein said inner wall of the outer body has at least one projection for butting against said idle member to stop said relative rotation.

19. A device as set forth in claim 16, wherein said first and second depressions are two parallel grooves, and said idle member is a round rod in shape.

* * * * *